US010352587B2

(12) United States Patent
Shaffer

(10) Patent No.: US 10,352,587 B2
(45) Date of Patent: Jul. 16, 2019

(54) WATER HEATER DISTRIBUTION TUBE

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 311 days.

(21) Appl. No.: 15/246,606

(22) Filed: Aug. 25, 2016

(65) Prior Publication Data

US 2018/0058721 A1 Mar. 1, 2018

(51) Int. Cl.

| | |
|---|---|
| ***F24H 9/20*** | (2006.01) |
| ***F24H 4/04*** | (2006.01) |
| ***F24H 9/12*** | (2006.01) |
| ***F24H 9/18*** | (2006.01) |

(52) U.S. Cl.

CPC ..... *F24H 9/2007* (2013.01); *F24H 4/04* (2013.01); *F24H 9/124* (2013.01); *F24H 9/18* (2013.01)

(58) Field of Classification Search

CPC ..... F24H 9/2007; F24H 9/18; F24H 9/124; F24H 4/04

USPC ... 122/14.3, 19.1, 235.29, 408.1, 414, 14.31

See application file for complete search history.

(56) References Cited

U.S. PATENT DOCUMENTS

| | | | | |
|---|---|---|---|---|
| 2,361,232 | A * | 10/1944 | Newhouse | F24H 1/186 236/33 |
| 2,704,534 | A * | 3/1955 | Dalin et al. | F22D 7/08 122/407 |
| 4,503,810 | A * | 3/1985 | Fujishita | F24H 9/2035 122/14.22 |
| 5,054,437 | A * | 10/1991 | Kale | F24H 9/124 122/19.1 |
| 2011/0132279 | A1* | 6/2011 | Le Mer | F24D 17/0031 122/14.3 |

FOREIGN PATENT DOCUMENTS

| | | |
|---|---|---|
| WO | WO2015053762 A1 | 4/2015 |
| WO | WO2015053767 A1 | 4/2015 |

* cited by examiner

*Primary Examiner* — Steven B McAllister
*Assistant Examiner* — Benjamin W Johnson
(74) *Attorney, Agent, or Firm* — Dority & Manning, P.A.

(57) ABSTRACT

A split system water heater includes a storage tank and a separate power module for heating water outside of the tank. A distribution tube provides high volume, low velocity flow of water between the tank and the power module to avoid or limit mixing and maintain thermal stratification within the tank. The distribution tube includes a longitudinal axis and a plurality of openings generally perpendicular to the longitudinal axis.

9 Claims, 6 Drawing Sheets

WATER HEATER DISTRIBUTION TUBE

FIELD OF THE INVENTION

The present subject matter relates generally to heat pump water heaters, such as a split system water heater with a water heater tank spaced from an external power module.

BACKGROUND OF THE INVENTION

Split system water heaters are gaining broader acceptance as a more economic and ecologically-friendly alternative to conventional electric resistance water heaters. These systems utilize an external heat source, sometimes called a power module, such as a heat pump. Consequently, water must be circulated within the split system, relatively cool water from the tank to the power module, and heated water from the power module to the tank.

Although split system water heaters are more energy-efficient, split system water heaters can be slower, i.e., take longer to fully heat a tank of water. It is desirable for various reasons to provide thermal stratification within the water heater tank.

Maintaining thermal stratification, e.g., keeping an upper portion hotter than the remainder of the tank, can be difficult in a split system. Water in the tank of a split system tends to mix vertically as the water is circulated between the tank and the power module, creating a uniform temperature mix throughout the tank.

Accordingly, a split system water heater with features for reducing vertical mixing in order to maintain thermal stratification within the tank would be useful.

BRIEF DESCRIPTION OF THE INVENTION

The present subject matter provides a distribution tube for a split system water heater. Additional aspects and advantages of the invention will be set forth in part in the following description, or may be apparent from the description, or may be learned through practice of the invention.

In a first exemplary embodiment, a water heater is provided. The water heater includes a power module for heating water, a tank separate from the power module, the tank defining a vertical direction and a lateral direction, and a distribution tube in the tank for receiving heated water into the tank from the power module. The distribution tube comprises a longitudinal axis extending generally along the lateral direction and a plurality of openings generally perpendicular to the longitudinal axis.

In a second exemplary embodiment, a method of operating a water heater appliance is provided. The method includes defining a threshold temperature, heating water in a power module, circulating the heated water with a high volume, low velocity flow from the power module to a recirculation zone in a storage tank separate from the power module, measuring the temperature in the recirculation zone, and recirculating the water with a high volume, low velocity flow from the recirculation zone to the power module for further heating and back to the recirculation zone until the temperature in the recirculation zone reaches the threshold temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
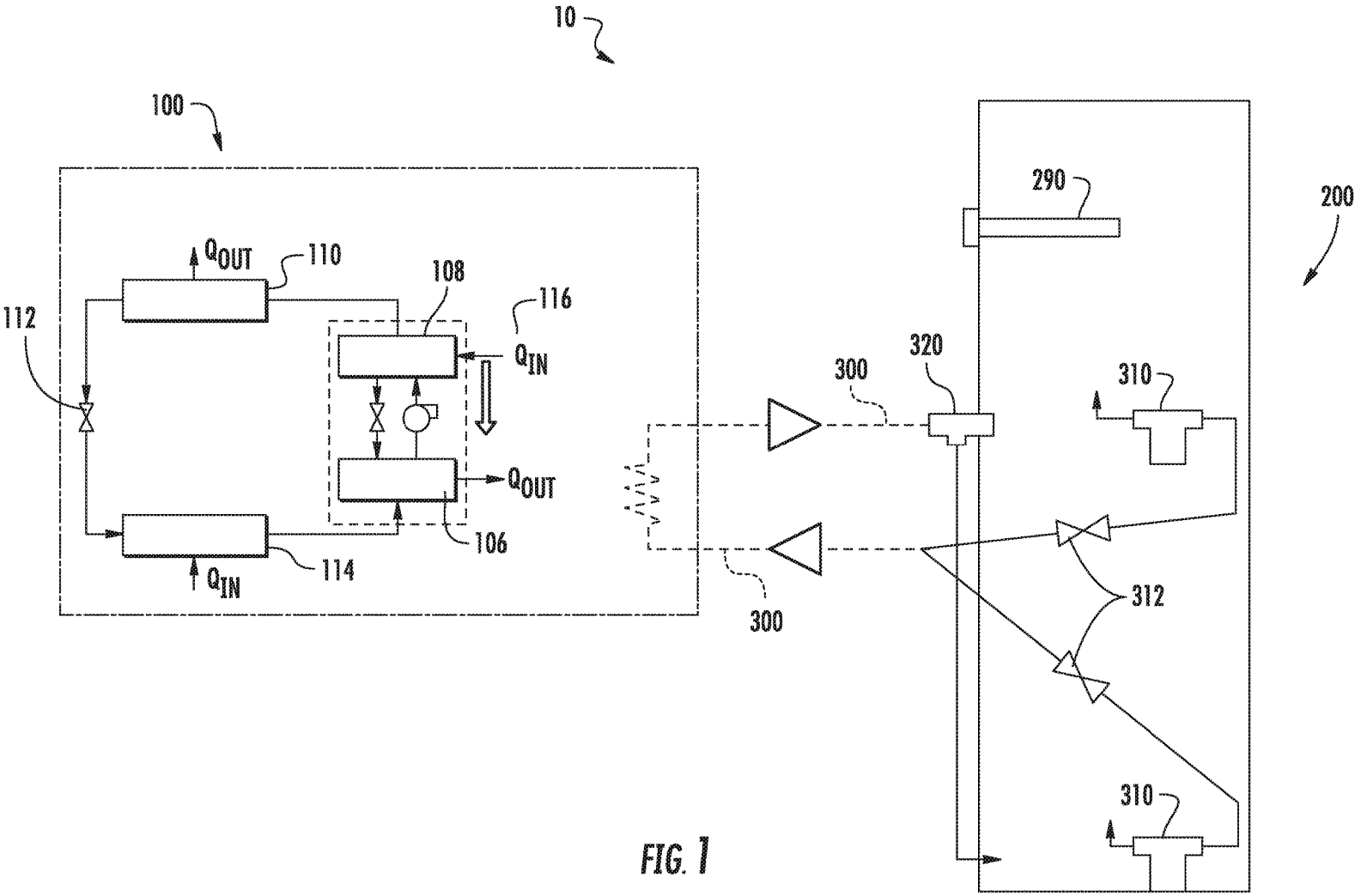
FIG. 1 provides a schematic illustration of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Although exemplary embodiments of the present disclosure will be described generally in the context of a water heater appliance for purposes of illustration, one of ordinary skill in the art will readily appreciate that embodiments of the present disclosure may be applied to any style or type of heater for a liquid and are not limited to water heaters or heating systems for water.

As may be seen in FIG. 1, a split system water heater 10 includes a power module 100 and a tank 200, which is separate from the power module 100. Power module 100 can be any suitable heater or heat exchanger for use in split system water heater 10. For example, in some exemplary embodiments, the power module 100 can be a gas sorption heat pump, e.g., as illustrated in FIG. 1.

As illustrated in FIG. 1, a gas sorption heat pump 100 may include a condenser 110, an evaporator 114 and an expansion valve 112. Additionally, gas sorption heat pump 100 may include an absorber 106 and a generator 108 with a sorbate (not shown) therein. As used herein, "sorbate" refers to material that can be combined with liquid or gas/vapor, referred to herein as a refrigerant, to create an exothermic reaction. Conversely, the sorbate can be heated to remove the refrigerant in an endothermic reaction. During operation of water heater 200, a heat source 116 is used to apply heat energy to generator 108. Heat energy from heat source 116 liberates refrigerant from the sorbate in generator 108, and the refrigerant may then flow to condensor 110 and/or absorber 106. Refrigerant can be reabsorbed into solution with the sorbate in absorber 106. Additional details regarding suitable exemplary gas sorption heat pumps may be discerned from commonly-owned International Publications WO 2015/053762 and WO 2015/053767, the entire contents of which are incorporated by reference herein.

During operation of a water heater appliance such as the example illustrated in FIG. 1, water (or other liquid to be heated) flows between power module 100 and tank 200 via conduits 300. The flow between power module 100 and tank 200 may be driven by one or more recirculation pumps 310. A check valve 312 may be provided downstream of pump 310 to prevent backflow when pump 310 is not operating. Flow into the tank 200 from the power module 100 may be selectively supplied to an upper recirculation zone 250 or a lower recirculation zone 260 using three-way valve 320.

Figure 2:
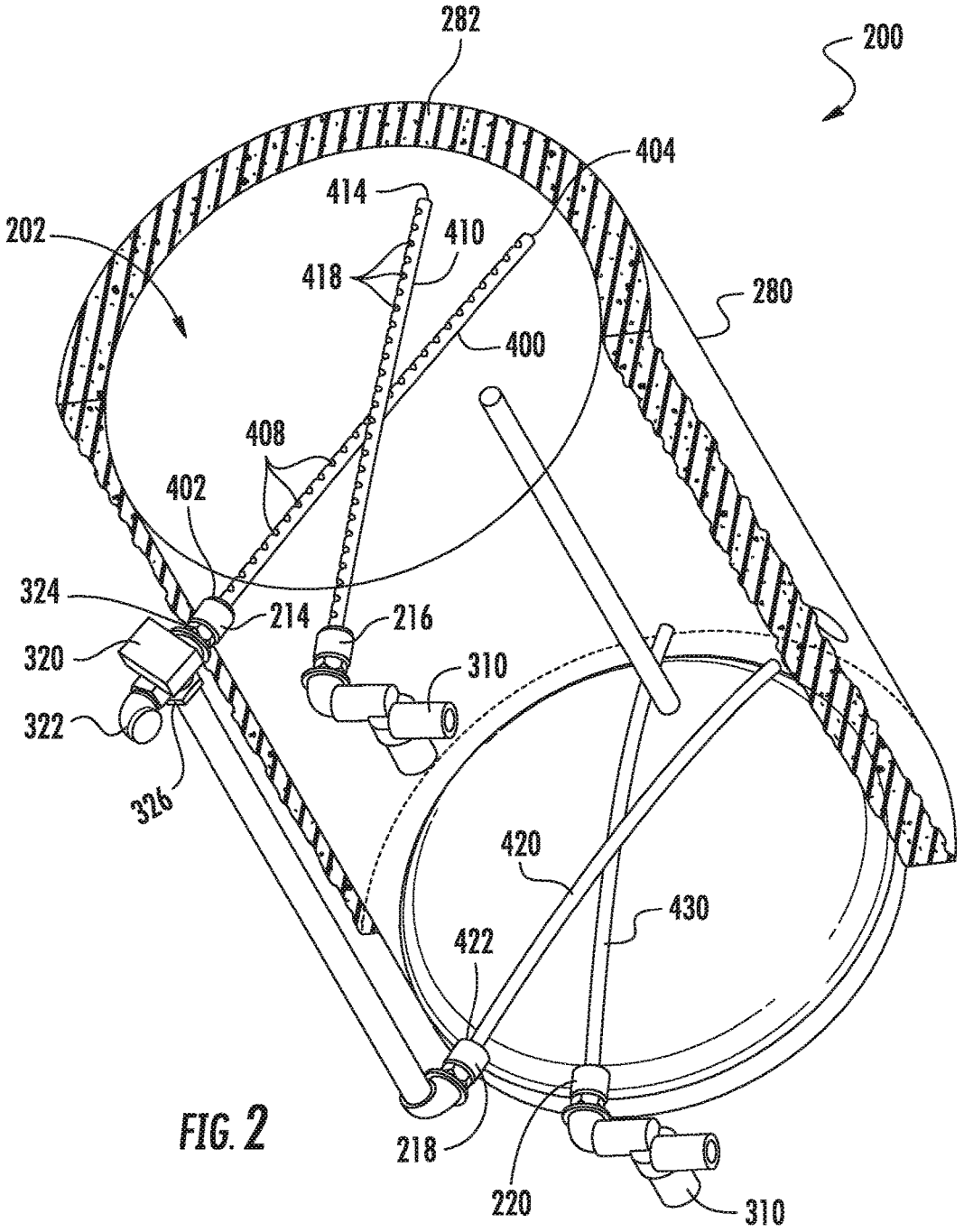
FIG. 2 provides a partial perspective view of a water heater appliance tank according to an exemplary embodiment of the present subject matter.

FIG. 2 illustrates a perspective view of an exemplary tank 200 which may be suitable for the water heater 10 with top end wall 208 and a portion of wrapper 280 removed to more clearly illustrate interior features of tank 200. Thus, components within the interior volume 202 of tank 200, and in particular upper recirculation zone 250 (see FIG. 3), may be seen in FIG. 2. In some embodiments, such as the example illustrated in FIG. 2, the tank 200 includes at least a first hot water inlet 214 from the power module 100 and at least a first recirculation outlet 216 to the power module 100.

Figure 4:
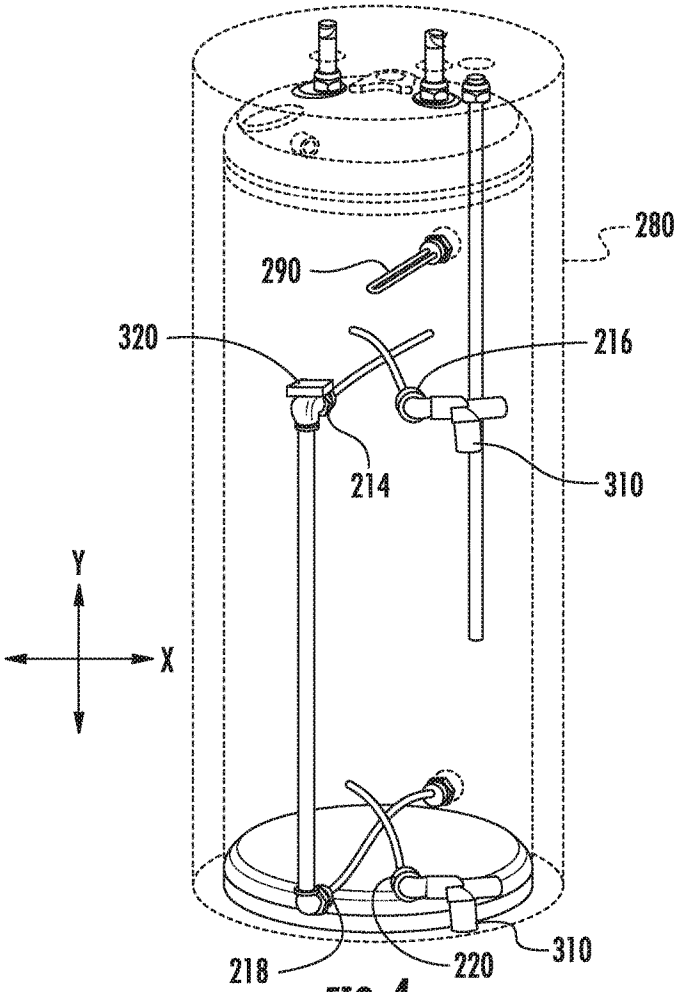
FIG. 4 provides an elevation view of the exemplary water heater appliance tank of FIG. 2.
Figure 3:
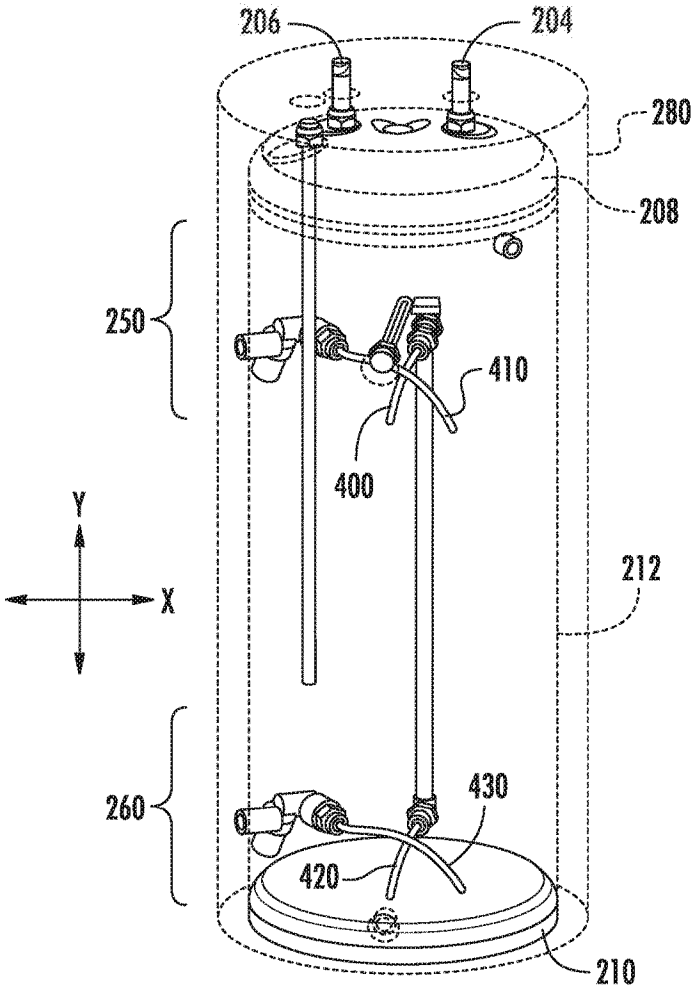
FIG. 3 provides an elevation view of the exemplary water heater appliance tank of FIG. 2.

As may be seen in FIGS. 3 and 4, the tank 200 defines a vertical direction Y and a lateral direction X that are perpendicular to each other. In some exemplary embodiments, the tank 200 may be cylindrical, in which case the lateral direction X may also correspond to a radial direction. The tank 200 comprises a cold water inlet 204, a hot water outlet 206, a top end wall 208, a bottom end wall 210, and one or more side walls 212 extending along the vertical direction Y between the top end wall 208 and the bottom end wall 210. Cold water entering via cold water inlet 204 may be directed towards a bottom portion of tank 200, e.g., proximate to bottom end wall 210, by a dip tube (not shown) which extends between cold water inlet 204 and an outlet (not shown) proximate bottom end wall 210. The top end wall 208, bottom end wall 210, and one or more side walls 212 define the interior volume 202. An outer shell or wrapper 280 may surround the tank 200. Insulation 282 may be provided between wrapper 280 and tank 200. In some embodiments, tank 200 may also have an electric resistance heating element 290 disposed therein for supplemental heating and/or for maintaining the temperature of stored water.

Figure 5:
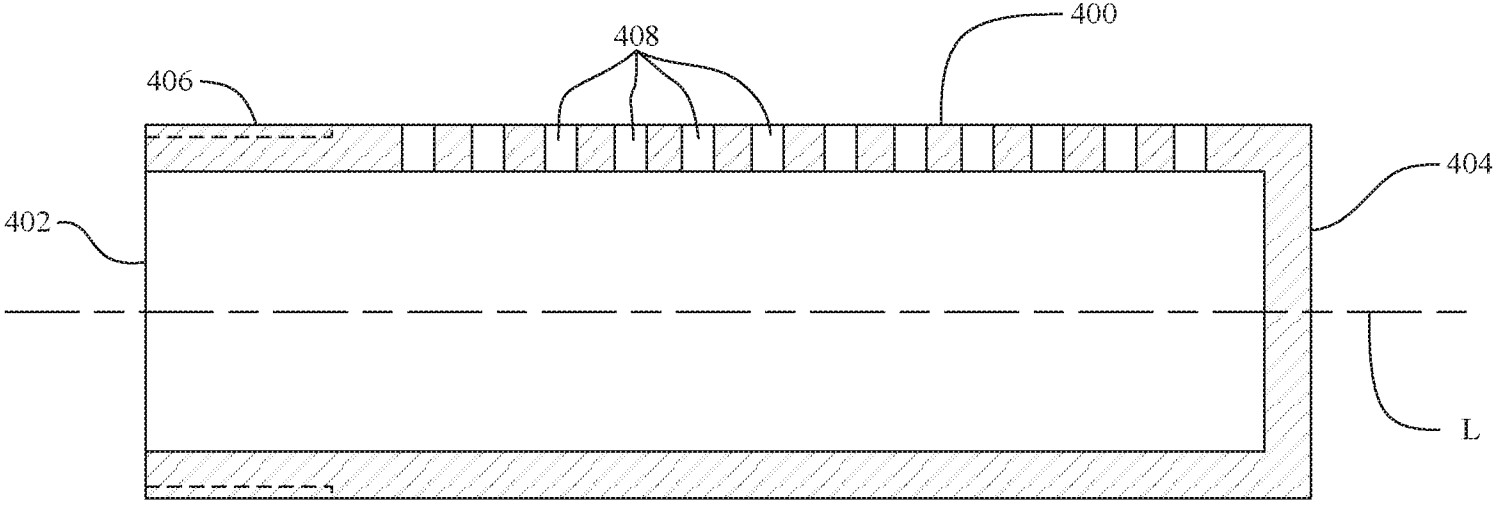
FIG. 5 provides a section view of a distribution tube according to an exemplary embodiment of the present subject matter.

Water enters the interior volume 202 of tank 200 via a distribution tube, and more specifically a first inlet tube 400. The first inlet tube 400 is generally an elongate cylinder and may have a slight degree of curvature in some exemplary embodiments. The longitudinal axis L of the first inlet tube 400 extends generally along the lateral direction X. The first inlet tube 400 has a first open end 402 and an opposing closed second end 404. First end 402 may be configured for connecting to another pipe, fitting, or other fluid handling device, e.g., pump 310 or valve 320, such as by forming external threads 406 on first end 402, for example as illustrated in FIG. 5. For example, in embodiments when the first end 402 is connected to the three-way valve 320, the first end 402 serves as an inlet into the first inlet tube 400 from the power module 100.

In order to provide a high volume, low velocity flow of water between the interior volume 202 of the tank 200 and the power module 100, the first inlet tube 400 has a plurality of openings 408. The inlet tube 400 may have a large number of openings 408 to provide a large overall flow volume at a slow rate to avoid or minimize mixing. One skilled in the art will recognize that flow equals velocity times area. For a given flowrate produced by the recirculation pump(s) 310, e.g., into the interior volume 202 from the power module 100, spreading that flow over a large cumulative area (i.e., the sum of the area of the plurality of openings 408) permits a low velocity. Because there is a relatively large number of openings 408, each opening 408 receives a relatively small fraction of the total flow at a low velocity.

The openings 408 may be transverse, e.g., generally perpendicular, to the longitudinal axis L. In the exemplary embodiment illustrated in FIG. 5, the openings 408 are perpendicular to longitudinal axis L, although they may also be at any other suitable angle, e.g., the openings 408 in some exemplary embodiments may be angled towards or away from the center of the tank 200 as desired. For instance, providing openings 408 at a substantial angle, e.g., ninety degrees (90°) or within a range thereof, to the incoming flow from open end 402 also serves to reduce the velocity and kinetic energy of the flow, as the incoming water must change directions before exiting inlet tube 400 and entering interior volume 202. As used herein, the term "generally perpendicular" or "transverse" means that openings are positioned and oriented such that fluid exits the openings flowing along a direction that is about ninety degrees (90°) from a stated axis when used in the context of openings.

Also provided is a second distribution tube, more specifically a first recirculation tube 410, which can be connected to a recirculation pump 310 to draw water from the interior volume 202 to the power module 100 for further heating. In some exemplary embodiments, such as those illustrated in the accompanying FIGS, the first inlet tube 400 and the first recirculation tube 410 may be structurally the same. However, one of ordinary skill in art will recognize that the structure of either tube 400 and/or 410 may vary, e.g., the shape or orientation of the openings may vary, either or both tubes may be straight or curved, etc. When the first inlet tube 400 is connected to the three-way valve 320, the plurality of transverse openings 408 serve as outlets from the first inlet tube 400 into the interior volume 202, whereas the plurality of transverse openings 418 of first recirculation tube 410 serve as inlets to the first recirculation tube 410 from the interior volume 202 when the first recirculation tube 410 is connected to the recirculation pump 310. The first recirculation tube 410 is located proximate to the first inlet tube 400 and has a large number of small inlets 418 and a single outlet 402 connected to the recirculation pump 310 for recirculating water to be heated by the power module 100. Thus, an upper recirculation zone 250 is provided in tank 200, e.g., in the upper approximately one-third of the tank 200, which can deliver heated water relatively quickly and directly from the power module 100 via upper recirculation zone 250 for ready supply to the user.

As indicated in FIG. 3, in some exemplary embodiments, a third and fourth distribution tube, more specifically second inlet tube 420 and second recirculation tube 430, respectively, are provided proximate the bottom end wall 210 of the tank 200. Thus, second inlet tube 420 and second recirculation tube 430 may create a second, lower recirculation zone 260, e.g., in the lower approximately one-third of tank 200. In such embodiments, tank 200 may have a second hot water inlet 218 and a second recirculation outlet 220. Additionally, in such embodiments, a three-way valve 320 may be connected to tank 200, and in particular, three-way valve 320 may be connected to first inlet tube 400 and second inlet tube 420. Valve 320 may comprise an inlet 322, a first outlet 324, and a second outlet 326. First outlet 324 may be connected to the first hot water inlet 214 of tank 200 and second outlet 326 may be connected to the second hot water inlet 218 of tank 200, such that heated water flowing from power module 100 can be selectively provided to first inlet tube 400 in the upper recirculation zone 250 via first hot water inlet 214 or to second inlet tube 420 in the lower recirculation zone 260 via the second hot water inlet 218.

The first and second recirculation tubes 410 and 430, as well as second inlet tube 420, are also configured to provide a high volume, low velocity flow of water between the interior volume 202 of the tank 200 and the power module 100, in a similar manner as discussed above with respect to the first inlet tube 400. Thus, while the exemplary distribution tube illustrated in FIG. 5 is nominally a first inlet tube 400, the same or similar structure may be provided in each of the other distribution tubes, i.e., first and second recirculation tubes 410 and 430, as well as second inlet tube 420. For instance, in either inlet tube 400 or 420, providing openings at an angle of about ninety degrees (90°) can serve to reduce the velocity and kinetic energy of the flow, as discussed above. The recirculation tubes 410 and 430 comprise similar structural features and also provide a high volume, low velocity flow based on the same principles, although the direction of the flow is reversed in the recirculation tubes 410 and 430 as compared to the inlet tubes 400 and 420. That is, water can flow from tank 200 to power module 100 via recirculation tubes 410 and 430 and can flow from power module 100 to tank 200 via inlet tubes 400 and 420.

The plurality of openings of each distribution tube 400, 410, 420, and 430 may be oriented in a single direction, e.g., along the vertical direction Y. As can be seen, e.g., in FIG. 2, the openings 408 and 418 of the upper distribution tubes 400 and 410 (i.e., first inlet tube 400 and first recirculation tube 410) point upwards, i.e., towards top end wall 208, to create the upper recirculation zone 250 and the openings (not shown) of the lower distribution tubes 420 and 430 (i.e., second inlet tube and second recirculation tube) point downwards, i.e., towards bottom end wall 210, to create the lower recirculation zone 260. The upper recirculation zone 250 is proximate to the hot water outlet 206 of tank 200, such that hot water may be supplied more directly to the end user, e.g., the lower portion of the tank may still be relatively cold while a volume of heated water is available for use from the upper recirculation zone 250.

In exemplary embodiments where the power module 100 is provided as a gas sorption heat pump, e.g., as illustrated in FIG. 1, the recirculation flowrates required for such systems can range from three-quarters (0.75) of a gallon per minute ("gpm") to one and a half (1.5) gpm. The gradients driven through the gas power module in such embodiments may be maintained at five to ten degrees Fahrenheit (5° F. to 10° F.) levels, i.e., water supplied to tank from power module 100 may be between five (5° F.) to ten (10° F.) degrees Fahrenheit warmer than water returned to power module 100 from tank 200. As a result, the recirculation amount can be around two hundred (200) gallons or more of water circulated between the power module 100 and the tank 200. Thus, it may take about three hours to completely heat a tank full of water from an initial non-heated, i.e., "cold," state as supplied from the water supply line of a home or building to the desired temperature set point. By initially providing hot water from the power module 100 to the upper recirculation zone 250 without mixing, where the upper recirculation zone is approximately one-third of the tank interior volume 202, a sufficient quantity hot water can be made available within the first hour of operation.

The desired temperature for water in the water heater appliance 10 may be set by a user, defining a set point for the desired water temperature. Initially, water may circulate between the upper recirculation zone 250 in tank 200 and the power module 100. As water is heated by the power module 100 and flows into tank 200 via first inlet tube 400, the heated water leaving first inlet tube 400 will mix with the water in the tank 200, preferably only or predominantly in the upper recirculation zone 250. Thus, the temperature of water in upper recirculation zone 250 may be quickly increased while water in lower portion of the tank 200 stays relatively cool. For example, the thermal stratification within interior volume 202 of tank 200 can result in a temperature difference between a temperature in upper recirculation zone 250 near the top end wall 208 and a temperature near the bottom end wall 210 of one hundred degrees Fahrenheit (100° F.) or more. Once the upper portion, e.g., the upper recirculation zone 250, reaches the desired temperature set point or is within a certain range, e.g., five degrees Fahrenheit (5° F.), thereof, water can be circulated to a lower portion of the tank 200 until the entire tank volume 202 reaches the desired temperature set point. An operating threshold temperature for the water heater appliance 10 can be defined based on the set point. The threshold temperature can be the setpoint itself or within a certain range, e.g., five degrees Fahrenheit (5° F.), thereof.

Figure 6:
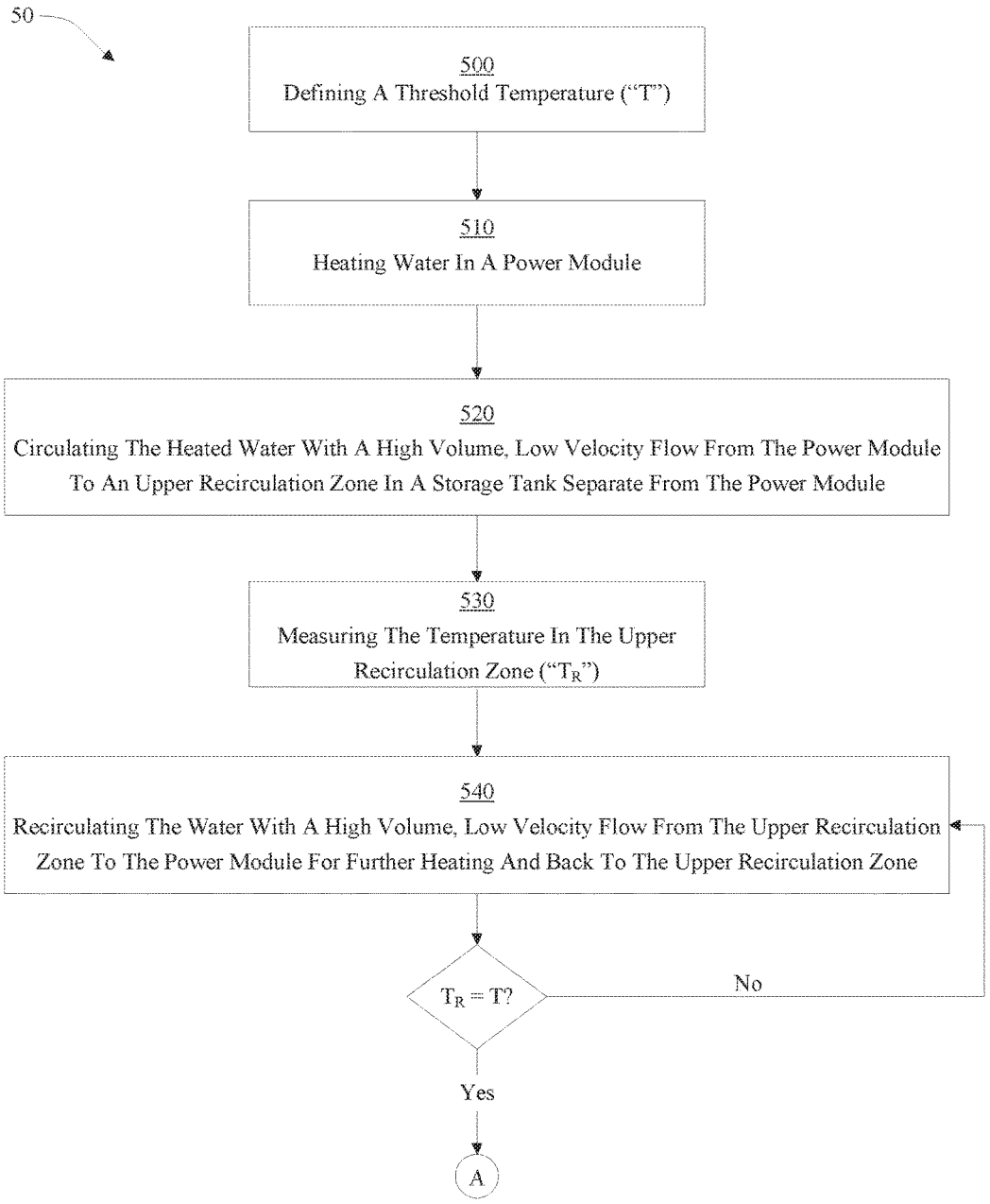
FIGS. 6 and 7 provide a flow chart illustrating a method according to various embodiments of the present disclosure.
Figure 7:
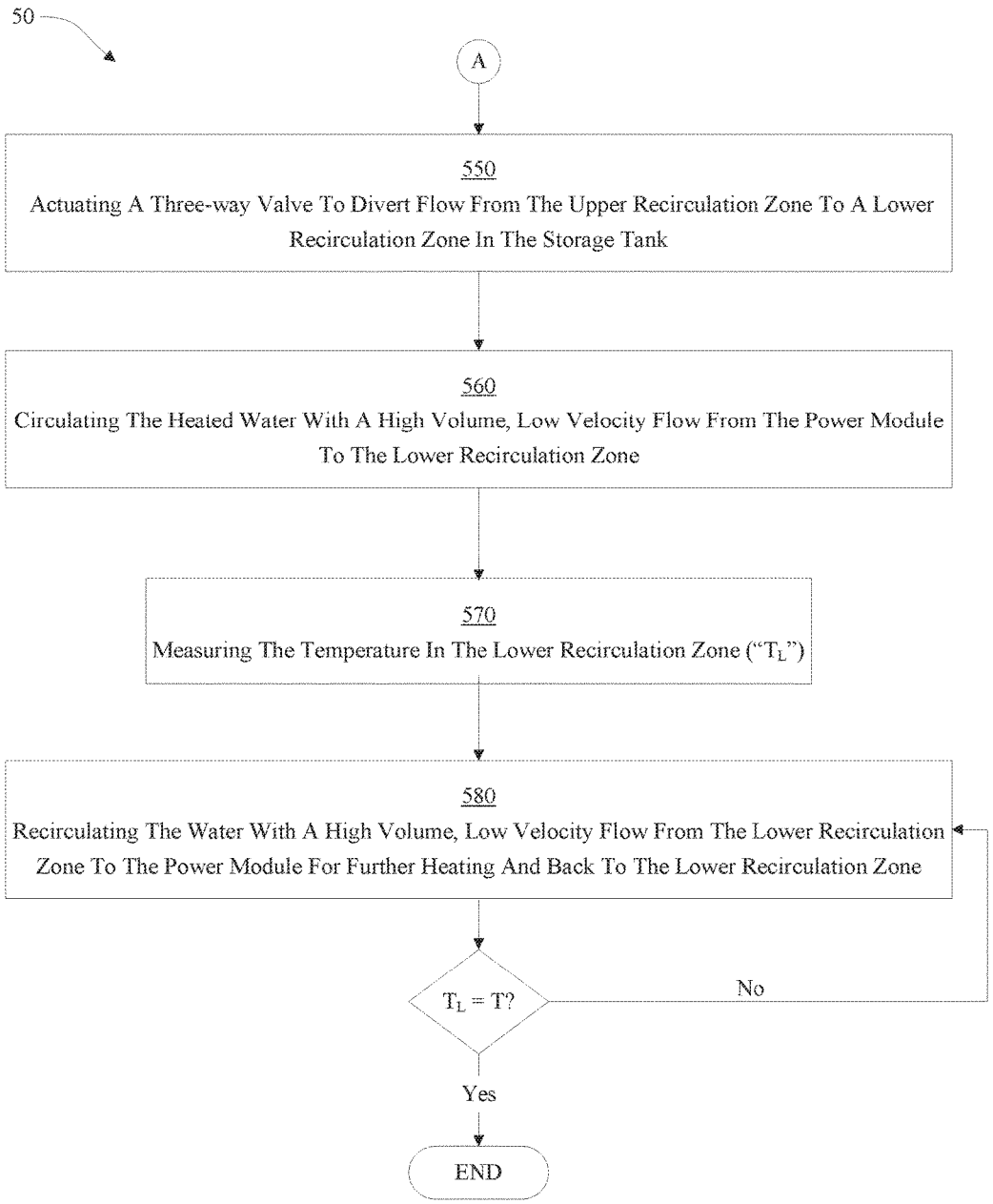

As may be seen in FIGS. 6 and 7, an example method 50 of operating a water heater appliance 10 can include the steps of defining a threshold temperature 500, heating water in a power module 510, circulating the heated water with a high volume, low velocity flow from the power module to a recirculation zone in a storage tank separate from the power module 520, measuring the temperature in the recirculation zone 530, and recirculating the water with a high volume, low velocity flow from the recirculation zone to the power module for further heating and back to the recirculation zone 540 until the temperature in the recirculation zone reaches the threshold temperature. In some exemplary embodiments, the recirculation zone may be an upper zone with a lower recirculation zone also provided, and in such exemplary embodiments, the method 50 may further include the steps of actuating a three-way valve to divert flow from the upper recirculation zone to the lower recirculation zone 550 when the temperature in the upper recirculation zone reaches the threshold temperature, circulating the heated water with a high volume, low velocity flow from the power module to a lower recirculation zone in the storage tank when the temperature in the upper recirculation zone reaches the threshold temperature 560, measuring the temperature in the lower recirculation zone 570, and recirculating water with a high volume, low velocity flow from the lower recirculation zone to the power module for further heating and back to the lower recirculation zone 580 until the temperature in the lower recirculation zone reaches the threshold temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance, comprising:

a power module for heating water;

a tank separate from the power module, the tank defining a vertical direction and a lateral direction that are perpendicular to each other, the tank extending along the vertical direction from a bottom end wall to a top end wall;

at least one outlet from the tank defined in the top end wall of the tank;

a first inlet tube in the tank for admitting heated water into the tank from the power module, the first inlet tube comprising a longitudinal axis extending generally along the lateral direction and a plurality of openings generally perpendicular to the longitudinal axis;

a first recirculation tube for recirculating heated water from the tank to the power module located proximate to the first inlet tube, the first recirculation tube comprising a longitudinal axis extending generally along the lateral direction and a plurality of openings generally perpendicular to the longitudinal axis;

an upper recirculation zone proximate the top end wall of the tank defined by the first inlet tube and the first recirculation tube;

a second inlet tube proximate the bottom end wall of the tank for admitting heated water into the tank from the power module, the second inlet tube comprising a longitudinal axis extending generally along the lateral direction and a plurality of openings generally perpendicular to the longitudinal axis;

a second recirculation tube proximate the bottom end wall of the tank for recirculating heated water from the tank to the power module, the second recirculation tube comprising a longitudinal axis extending generally along the lateral direction and a plurality of openings generally perpendicular to the longitudinal axis; and a lower recirculation zone proximate the bottom end wall of the tank defined by the second inlet tube and the second recirculation tube.

2. The water heater appliance of claim 1, wherein the plurality of openings of the first inlet tube are oriented in a first direction toward the top end wall of the tank along the vertical direction and the plurality of openings of the first recirculation tube are oriented in the first direction toward the top end wall of the tank along the vertical direction.

3. The water heater appliance of claim 1, wherein each of the first inlet tube and the first recirculation tube is an elongated cylinder with a first end in fluid communication with the power module and an opposing closed second end spaced from the first end along the lateral direction.

4. The water heater appliance of claim 1, further comprising a three-way valve in fluid communication with the first inlet tube and in fluid communication with the second inlet tube, the valve operable for selectively providing fluid flow from the power module to either the first inlet tube or the second inlet tube.

5. The water heater appliance of claim 2, wherein the plurality of openings of the second inlet tube and the plurality of openings of the second recirculation tube are oriented in a second direction along the vertical direction, wherein the second direction is opposite of the first direction.

6. The water heater appliance of claim 1, further comprising a recirculation pump operatively connected with the first recirculation tube for pumping water from the tank to the power module.

7. The water heater appliance of claim 6, further comprising a check valve downstream of the recirculation pump.

8. The water heater appliance of claim 1, further comprising a recirculation pump operatively connected with the second recirculation tube for pumping water from the tank to the power module.

9. The water heater appliance of claim 8, further comprising a check valve downstream of the recirculation pump.

* * * * *